US007792479B2

(12) United States Patent
Yasumoto

(10) Patent No.: US 7,792,479 B2
(45) Date of Patent: Sep. 7, 2010

(54) IMAGE FORMING APPARATUS WITH ERROR CORRECTION FOR LENGTH OF TRANSFER SHEET

(75) Inventor: Takeshi Yasumoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 810 days.

(21) Appl. No.: 11/435,878

(22) Filed: May 18, 2006

(65) Prior Publication Data

US 2006/0269337 A1 Nov. 30, 2006

(30) Foreign Application Priority Data

May 27, 2005 (JP) ..... 2005-155534

(51) Int. Cl.
*G03G 15/00* (2006.01)

(52) U.S. Cl. ..... 399/388; 399/395; 399/396; 271/261; 271/265.03

(58) Field of Classification Search ..... 399/388, 399/395, 396; 271/261, 265.03
See application file for complete search history.

(56) References Cited

U.S. PATENT DOCUMENTS

| | | | | |
|---|---|---|---|---|
| 5,090,683 | A * | 2/1992 | Kamath et al. | 271/227 |
| 5,305,995 | A | 4/1994 | Nakajima et al. | 271/18 |
| 6,533,263 | B2 | 3/2003 | Tamura | 271/10.01 |
| 6,934,504 | B2 | 8/2005 | Morita | 399/394 |
| 2001/0022422 | A1 | 9/2001 | Tamura | 271/10.03 |
| 2005/0002712 | A1 | 1/2005 | Morita | 399/394 |

FOREIGN PATENT DOCUMENTS

| | | |
|---|---|---|
| EP | 1 253 478 | 1/2002 |
| JP | 10-190975 | 7/1998 |
| JP | 11-237768 | 8/1999 |
| JP | 2002-338084 | 11/2002 |
| JP | 2003-35974 | 2/2003 |
| JP | 2003-241610 | 8/2003 |

OTHER PUBLICATIONS

European Search Report, issued Jan. 24, 2007, in European Application No. 06010781.0.

* cited by examiner

*Primary Examiner*—Judy Nguyen
*Assistant Examiner*—Andy L Pham
(74) *Attorney, Agent, or Firm*—Fitzpatrick, Cella, Harper & Scinto

(57) ABSTRACT

An image forming apparatus is configured so that a first detection position and a second detection position are set along the direction of conveying a transfer material between adjacent conveyance rollers. The image forming apparatus has four sensors, two of which are disposed in the first detection position at a predetermined interval, and the remaining two of which are disposed in a second detection position at a predetermined interval. An actual length of the transfer material can be detected with high accuracy by performing (1) cancellation of an error in detection caused by variation in a speed at which the transfer material is conveyed, (2) cancellation of an error in detection caused by a skew, and (3) cancellation of an error in detection caused by oblique passing.

11 Claims, 9 Drawing Sheets

IMAGE FORMING APPARATUS WITH ERROR CORRECTION FOR LENGTH OF TRANSFER SHEET

BACKGROUND OF THE INVENTION

1. Field of the Invention

The present invention relates to an image forming apparatus configured to form an image on a transfer material in, for example, electrographic printers, copiers, and printing machines.

2. Description of the Related Art

There are a plurality of types, such as an electrographic type, a offset printing type, and an inkjet type, of image forming apparatuses. Hereinafter, related techniques are described by taking an electrographic type color image forming apparatus as an example.

Color image forming apparatuses are classified according to its configuration mainly into either a tandem type in which a plurality of image forming units are arranged side by side, or a rotary type in which a plurality of image forming units are cylindrically arranged. Color image forming apparatuses are also classified according to the employed transfer technique, mainly into a direct transfer type in which a toner image is transferred onto a sheet material from a photoreceptor, or an intermediate transfer type in which a toner image is once transferred onto an intermediate transfer member and in which the transferred image is subsequently transferred from the intermediate transfer member to a sheet material.

FIG. 9 is a cross-sectional view of an image forming apparatus of the intermediate transfer tandem type in which four color image forming units are arranged on an intermediate transfer belt. The image forming apparatus of the intermediate transfer type does not need to hold the transfer material on a transfer drum or a transfer belt, while the apparatus of the direct transfer type should hold the transfer material thereon. Thus, the image forming apparatus of the intermediate transfer type can deal with a broader variety of transfer materials, such as super-thick paper and coated paper. Also, the image forming apparatus of the intermediate transfer type is advantageous in that parallel processing can be performed in a plurality of image forming units and that a batch transfer of full color images can be achieved. Consequently, the image forming apparatus of the intermediate transfer type is suitable for realizing high productivity. Hereinafter, an operation of the image forming apparatus is described below by referring to FIG. 9.

A transfer material S is accommodated by being loaded on a lifting-up unit 52 in a paper feeding apparatus 51. The transfer material S is fed by a paper feeding unit 53 in synchronization with image formation in image forming apparatus 50. The paper feeding unit 53 may be of the type that utilizes friction separation due to a paper feeding roller, or of the type that utilizes separation attachment due to air. The apparatus shown in FIG. 9 employs the paper feeding unit of the latter type that utilizes air in feeding paper. The transfer material S fed by the paper feeding unit 53 passes through a conveyance path 54*a* of a conveyance unit 54 and is conveyed to a registration unit 55. After skew correction and timing correction are performed on the transfer material S in the registration unit 55, the transfer material S is sent to a secondary transfer unit. The secondary transfer unit is a toner image transfer nip unit that consists of a secondary transfer inner roller 503 and a secondary transfer outer roller 56, which are substantially opposed to each other, and that transfers a toner image onto the transfer material S. The secondary transfer unit provides a predetermined pressing force and an electrostatic load bias thereby to cause an unfixed image to be adsorbed onto transfer paper.

A process of forming an image sent to the secondary transfer at a timing similar to that at which the above-described process of conveying the transfer material S to the secondary transfer unit is performed, is described below. An image forming unit 513 consists primarily of a photoreceptor 508, an exposure unit 511, a developing unit 510, a primary transfer unit 507, and a photoreceptor cleaner 509. The exposure unit 511 emits light to the photoreceptor 508, which has a surface preliminarily uniformly charged by a charging unit and is rotated in a direction of an arrow A shown in this figure, according to an image information signal sent thereto. The light passing through a diffraction unit 512 forms a latent image. Then, toner development is performed on the electrostatic latent image formed on the photoreceptor 508 in this way. Thus, a toner image is formed on the photoreceptor 508. Subsequently, the primary transfer unit 507 provides the predetermined pressing force and the electrostatic load bias to thereby transfer the toner image onto the intermediate transfer belt 506. Thereafter, a small amount of untransferred toner left on the photoreceptor 508 is collected by the photoreceptor cleaner 509. Then, the toner is prepared for forming the next image again. The apparatus shown in FIG. 9 has four image forming units 513, which are constructed as described above and respectively correspond to yellow (Y), magenta (M), cyan (C), and black (Bk).

Next, the intermediate transfer belt 506 is described below. The intermediate transfer belt 506 is stretched by rollers, such as a drive roller 504, a tension roller 505, and a secondary transfer inner roller 503, and is driven and conveyed in the direction of an arrow B shown in this figure. Thus, a process of forming images respectively corresponding to the colors Y, M, C and Bk by the image forming units 513 in parallel to one another is performed at a timing with which each of these images is superimposed on the upstream toner image having been primary-transferred onto the intermediate transfer belt. Consequently, a full-color toner image is formed on the intermediate transfer belt 506 and is conveyed to the secondary transfer roller 56.

After the process of conveying the transfer material S and the process of forming the images are performed, the full-color toner images are secondary-transferred onto the transfer material S in the secondary transfer unit. Subsequently, the transfer material S is conveyed by a pre-fixation conveyance unit 57 to a fixing unit 58. The fixing unit 58 is operative to heat-fix the toner onto the transfer material S by utilizing the predetermined pressing force of the rollers substantially opposed to each other or to the belt and also utilizing heating effects of a heat source, which is usually a heater. Then, one of conveyance paths of the transfer material S having a fixed image obtained in this way is selected by a branch conveyance unit 59. That is, in the case of one of the conveyance paths, the transfer material S is discharged directly to a discharging tray 500. Alternatively, in a case where two-sided image formation should be performed, the transfer material S is conveyed to a reversal conveyance unit 501.

An operation of conveying the transfer material S in the case of performing the two-sided image formation is described below. The leading end and the trailing end of the transfer material S sent to the reversal conveyance unit 501 are interchanged by performing a switchback reversal operation. Then, the transfer material S is conveyed to a two-sided transfer material conveyance unit 502. Subsequently, this transfer material S is joined with a transfer material, which is conveyed from the paper feeding unit 51 in the subsequent job, from a paper refeeding path 54*b* of the conveyance unit 54 at the right timing. Similarly, the joined transfer materials S are sent to the secondary transfer unit. A process of forming an image on a rear surface (that is, a second side) of the transfer material S is similar to the process of forming an image on a front surface (that is, a first side) of the transfer material S. Thus, the description of the process of forming an image on the rear surface is omitted herein.

As described above, the image forming apparatus 50 employs the switchback method to reverse the transfer material. The switchback method is the most commonly employed method reversing a transfer material because the configuration is simple and is space-saving. However, the switchback method has a drawback in that when image transfer is performed on the front and rear surfaces of the transfer material, a reference for the direction of conveying the transfer material is changed, that is, the leading end and the trailing end of the transfer material are interchanged. As described above, the image forming apparatus configured as illustrated in FIG. 9, is advantageous in high productivity and media supportability. Thus, recently, the image forming apparatus has been usually used for near-print purposes (typically, for print-on-demand applications). In such a case, very high image printing accuracy is demanded. Thus, the registration unit 55 usually has a configuration that is advantageous for skew-correction, and has, for example, a skew roller system. Under such conditions, the presence of different references for the direction of conveying the transfer material, which respectively correspond to the front side and the rear side of the transfer material, is a large obstacle to the achievement of the image printing accuracy, especially, the accuracy of displacement of an end margin in a direction of conveying the transfer material (that is, an auxiliary scanning direction). This is because of minute variations in the dimension of preliminarily cut transfer materials. Thus, as long as the transfer of the toner image on the intermediate transfer belt 506 is performed onto the front surface and the rear surface of the transfer material in the opposite directions, respectively, the end margin varies by an amount of the variation in the dimension of the transfer material even when the transfer of the toner image on the intermediate transfer belt 506 is made to coincide with the formation of the image on the transfer material S in a uniform way. Consequently, a blank part of the image or an additional margin occurs in a cutting process or a folding process. This may cause a quality problem.

To solve such a problem, various related techniques have been proposed to recognize the same reference at the transfers of the toner image onto the front surface and the rear surface of the transfer material, respectively, as described in Japanese Patent Application Laid-Open No. 10-190975. According to a certain related technique, an amount of variation is detected and is corrected by, for example, adding indistinctive dot patterns to the transfer material and then counting the added dot patterns. However, the formation of essentially unnecessary dot patterns on the transfer material results in wasteful consumption of toner. Sometimes, a claim may be made for the patterns themselves.

Therefore, a related method of detecting a reference for the transfer material itself, that is, an edge thereof, has become the norm. As described in, for instance, Japanese Patent Application Laid-Open No. 2003-35974, a detection unit is provided that is adapted to detect a rear end (that is, a front end serving as a reference at the transfer of the image onto the front surface of the transfer material) of the transfer material in the process of interchanging the leading end and the trailing end of the transfer material and then refeeding the transfer material. The position of an end of the transfer material and the timing, with which an image is formed, are calculated according to a detection signal.

Also, in a related technique described in Japanese Patent Application Laid-Open No. 11-237768, a detection unit is provided to detect the leading end and the trailing end of the transfer material. A rear end margin is calculated from positional information on the rear end of the transfer material, which is detected when the image is transferred onto the front surface. Consequently, when the leading end of the transfer material (that is, the rear end thereof detected at the transfer of the image onto the front surface) is detected, the position of the image on the rear surface is set according to the value of the rear end margin.

However, even when the end margins at the transfers of the image onto the front surface and the rear surface are made to coincide with each other, it is actually difficult to obtain the sufficient quality of a print product. This is because the transfer material, onto the rear surface of which the image is transferred, has been provided with the toner image transferred onto the front surface thereof, which is fixed thereto by the fixing unit 58 in the image forming apparatus 50 illustrated in FIG. 9, so that the transfer material contracts in a direction of width of the transfer material which is perpendicular to the direction of conveying the transfer material (that is, a main scanning) and in a direction of conveying the transfer material (that is, an auxiliary direction). There is variation in the contraction of the transfer material, which is caused after the transfer material passes through the fixing unit 58, in the direction of interspaces extending among fibers thereof depending upon the rate of evaporation of moisture contained in the transfer material. Thus, there is the need for providing a unit which is adapted so that the end margins respectively corresponding to the front surface and the rear surface are equal to each other, and that the magnification of the image formed on the front surface is made to be equal to the magnification of the image formed on the rear surface, so as to set exactly the same image position accuracy corresponding to each of the front surface and the rear surface of the transfer material. For example, Japanese Patent Application Laid-Open Nos. 2002-338084 and 2003-241610 describe units adapted to take notice of change in the magnification of each of the images respectively formed on the front surface and the rear surface and to make the magnification of the image formed on the front surface and that of the image formed on the rear surface to be equal to each other.

Generally, in a case where the image position accuracy of a print product is stringently required in, for example, a printing market, it is necessary that the approximate displacement in the auxiliary direction between the images respectively formed on the front surface and the rear surface is ±0.5 mm to ±1 mm. This displacement is caused mainly by mechanical tolerance and by variation due to the transfer material. The former cause may be suppressed to a certain degree by controlling the number and the precision of intervenient mechanical parts. However, it is difficult to directly suppress the latter cause. Conversely, the printing accuracy of the image forming apparatus depends upon how variation due to the transfer material can be suppressed.

Thus, there have been proposed various techniques of estimating the length of the transfer material by utilizing a detection unit adapted to detect the leading end and the trailing end of the transfer material. To actually achieve the aforementioned accuracy of approximately ±0.5 mm to ±1 mm, practical realization of such a unit is difficult, unless the accuracy of detection or estimation of the length of the transfer material is equal to or less than ±0.3 mm. The value ±0.3 mm is an approximate value of variation of expansion or contraction of the transfer material under the same conditions (the kinds, the image, and the environment of the transfer material). In a case where the precision of detection or estimation of the length of the transfer material is less than this approximate value, in order to obtain good image position accuracy, it is better to select a method in which an operator measures the displacement of the image between the images formed on the front surface and the rear surface from an output sample and also inputs a uniform correction value, though this is troublesome.

From this viewpoint, the aforementioned related art is insufficient for achieving the image position accuracy stringently required in the printing market, due to many error factors in detection and estimation of the length of the transfer material. This is because of the facts that a phenomenon of minute oblique passing (that is, the transfer material is conveyed in an inclined posture), strictly speaking, occurs in the transfer material to be conveyed, and that a minute skew (the posture of the transfer material is inclined due to the difference in circumferential velocity between the left and right conveyance rollers) occurs therebetween. Also, the conveyance roller has initial variation in outside diameter and, changes and varies in durability due to wear, so that a difference in conveying speed is caused among a plurality of rollers conveying the transfer material. Thus, a signal outputted by the detection unit includes substantial errors, so that the estimated length of the transfer material deviates significantly from the actual length thereof.

Although the related detection unit can detect timing with which the leading end and the trailing end of the transfer material pass therethrough, this detection unit cannot detect the influence of the oblique passing, the skew, or the difference in the conveyance speed. It has been described that the length of the transfer material and an amount of shift in the timing, with which the image is formed, are calculated according to a detection signal. However, the length of the material and the amount of shift are calculated according to these methods assuming that the speed of conveying the transfer material is an ideal speed. Thus, even in this process, the signal includes errors having significant influence on the accuracy of estimation.

SUMMARY OF THE INVENTION

An aspect of the present invention is to overcome the problem that high image position accuracy cannot be realized only by providing the detection unit adapted to simply detect the leading end and the trailing end of the transfer unit, and is, for example, to provide an image forming apparatus employing a method of canceling error factors, in addition to a detection unit.

In one aspect of the present invention, an image forming apparatus having an image forming unit adapted to form an image on a transfer material, which includes a first conveyance unit and a second conveyance unit serially arranged along a direction of conveyance of the transfer material, a first sensor and a second sensor disposed arranged along a direction perpendicular to the direction of conveyance of the transfer material, at a first detection position provided between the first conveyance unit and the second conveyance unit, a third sensor and a fourth sensor arranged along the direction perpendicular to the direction of conveying the transfer material, at a second detection position provided downstream from the first detection position, a computation unit adapted to calculate a length of the transfer material by correcting an error in detection of the length in the direction of conveyance of the transfer material, which is caused by a posture of the transfer material and by change in the posture thereof, according to detection signals representing a leading end and a trailing end of the transfer material, which are detected by the first to the fourth sensors, and a control unit adapted to adjust an image forming position on the transfer material according to length information on the length in the direction of conveyance of the transfer material, which is obtained by the computation unit.

Further features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE EMBODIMENTS

Embodiments of the invention will be described in detail below with reference to the drawings.

First Embodiment

Figure 1:
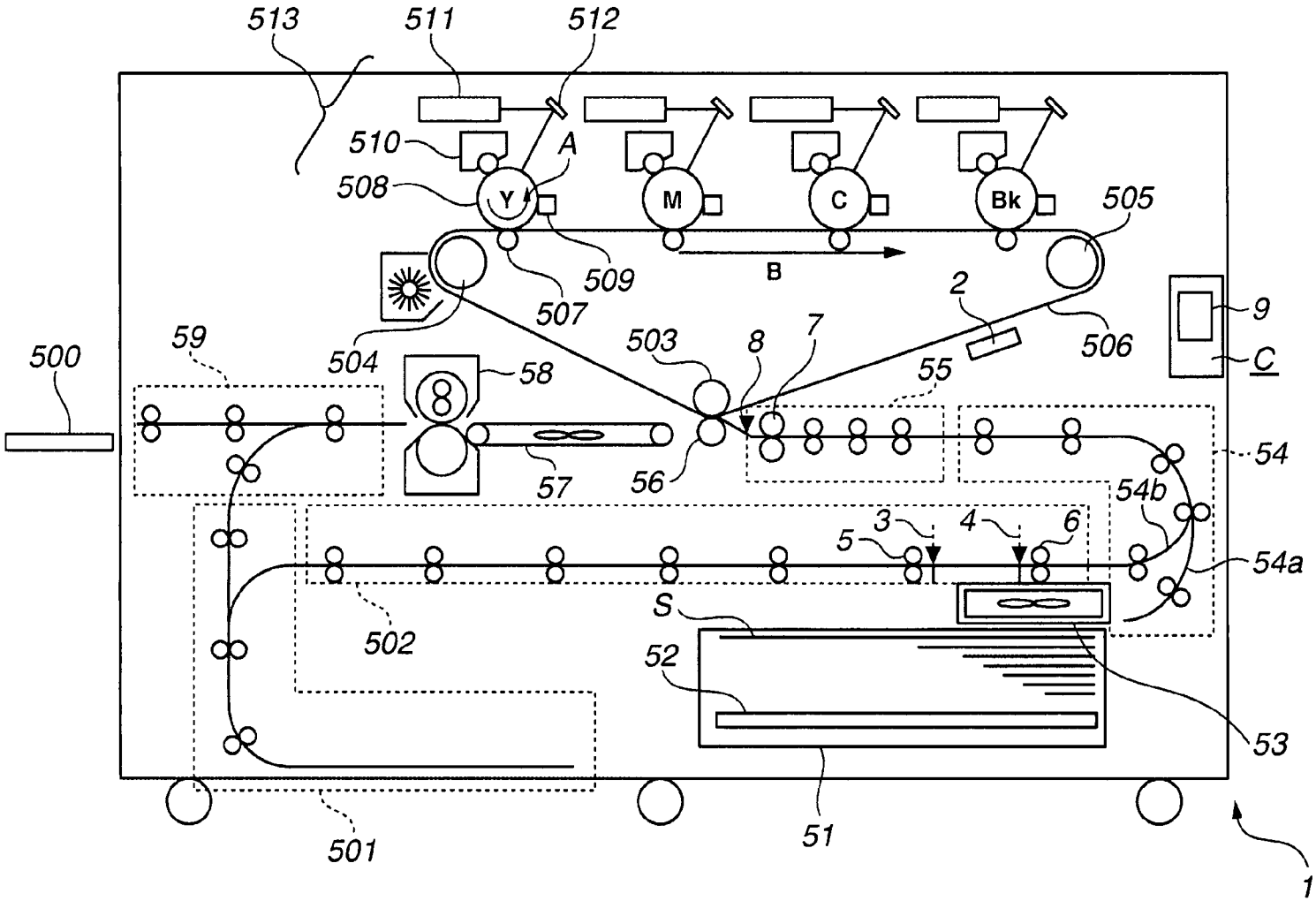
FIG. 1 is a cross-sectional view illustrating an image forming apparatus according to a first embodiment of the present invention.
Figure 9:
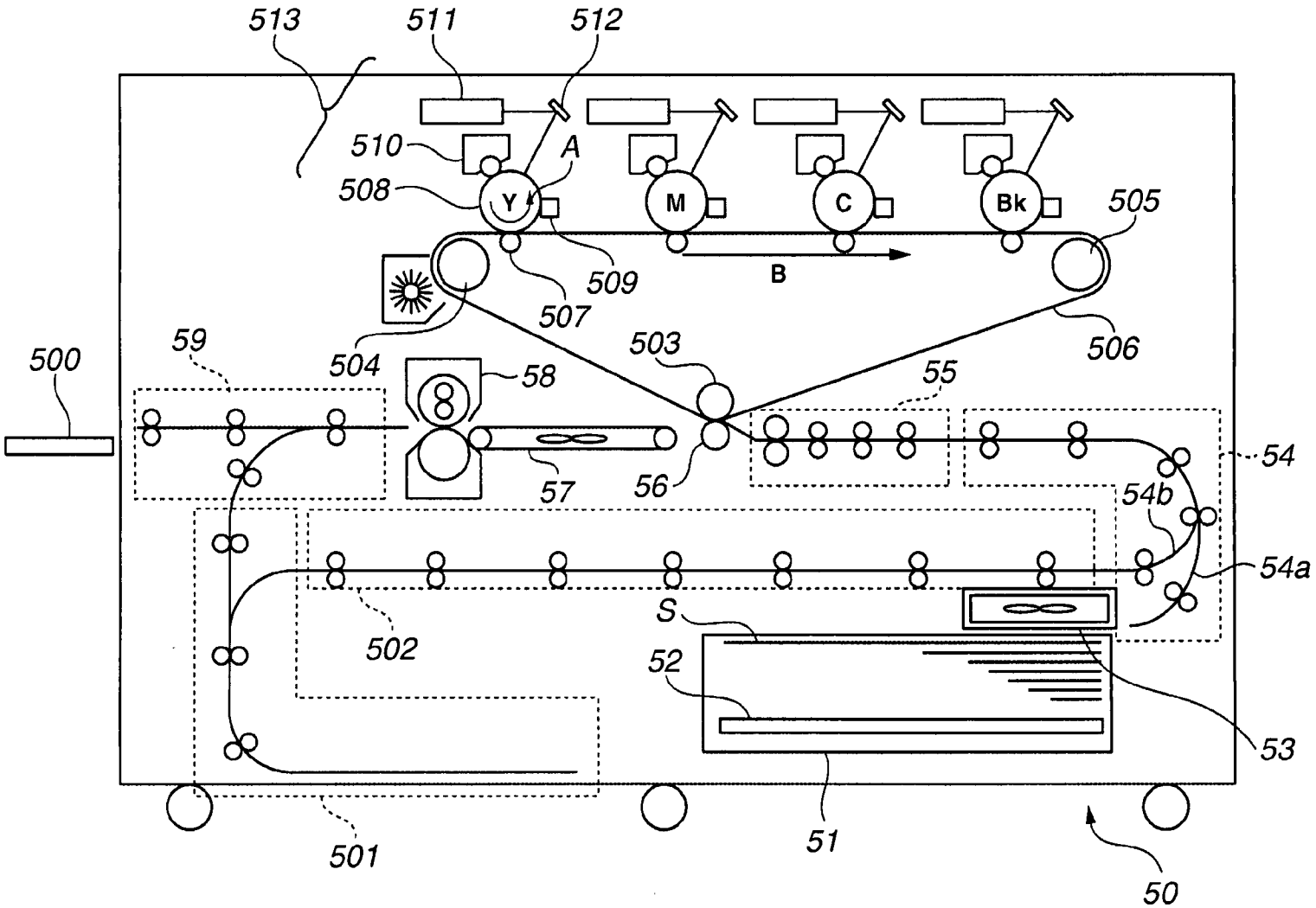
FIG. 9 is an explanatory cross-sectional view illustrating a related image forming apparatus.

FIG. 1 is a cross-sectional view illustrating an image forming apparatus according to a first embodiment of the present invention. The image forming apparatus shown in FIG. 1 is similar in basic configuration and operation to the image forming apparatus shown in FIG. 9. Like reference numerals designate each common part. The image forming apparatus 1 shown in FIG. 1 is of the intermediate transfer tandem type that has four image forming units 513 respectively corresponding to the colors Y, M, C, and Bk on an intermediate transfer belt 506. The image forming apparatus 1 is configured so that images can be formed on both of the front surface and the rear surface of the transfer material S.

The image forming apparatus 1 has a unit adapted to make a leading end of a toner image, which is formed by serially superposing four color images on the intermediate transfer belt 506, coincide with a leading end of the transfer material S conveyed by a feeding unit in a secondary transfer unit (that is, a transfer nip constituted by a secondary transfer inner roller 503 and a secondary transfer outer roller 56). More specifically, the image forming apparatus 1 has a pattern detection unit 2 at a position facing the intermediate transfer belt 506. An image leading-end pattern formed on the intermediate belt 506 is read by the pattern detection unit 2. The image leading-end pattern is a marker image provided at a leading end part of the actual toner image to be transferred and serves as a reference for coinciding with the leading end of the transfer material S. Consequently, it is determined how long the toner image, which is formed on the intermediate transfer belt 506, takes to reach the secondary transfer unit.

On the other hand, the transfer material S is conveyed from a paper feeding unit 53 to a registration unit 55 through a conveyance unit 54. It is determined by the sensor 8 of the registration unit 55 how long the transfer material S takes to reach the secondary transfer unit. Thus, the image forming timing or change in the speed of conveying the registration roller 7 is controlled according to results of both of the determinations respectively made by the unit 2 and the sensor 8. This enables the leading end of the image and that of the transfer material S to coincide with each other at a desired position. It is now assumed that the image forming apparatus 1 shown in FIG. 1 performs leading-end adjustment by performing a method of controlling the speed of conveying the registration roller 7. Errors are reduced by performing correction of the oblique passing by the transfer material S and setting the position of the sensor 8 to be closer to the secondary transfer position (for example, a position downstream from the registration roller 7 shown in FIG. 1).

Various types of registration units 55 may be employed. In the image forming apparatus shown in FIG. 1, the registration unit 55 is of the type adapted to perform correction of the oblique passing by using an obliquely feeding roller and an abutting reference member is used by way of example. FIGS. 3A to 3D are top views illustrating the registration unit of the obliquely feeding type. The registration unit 55 mainly includes a movable guide 30, a fixed guide 33, and a registration roller 7. The movable guide 30 can be moved in the direction of the width of the transfer material, which is perpendicular to the direction of conveying the transfer material (that is, the main scanning direction) according to the size of the transfer material S. The movable guide 30 includes the abutting reference member 31 and a plurality of obliquely feeding rollers 32. The obliquely feeding rollers 32 are inclined to the direction of conveying the transfer material by an angle $\alpha$ and are set to obtain an abutting conveyance component corresponding to the abutting reference member 31.

Figure 3A:
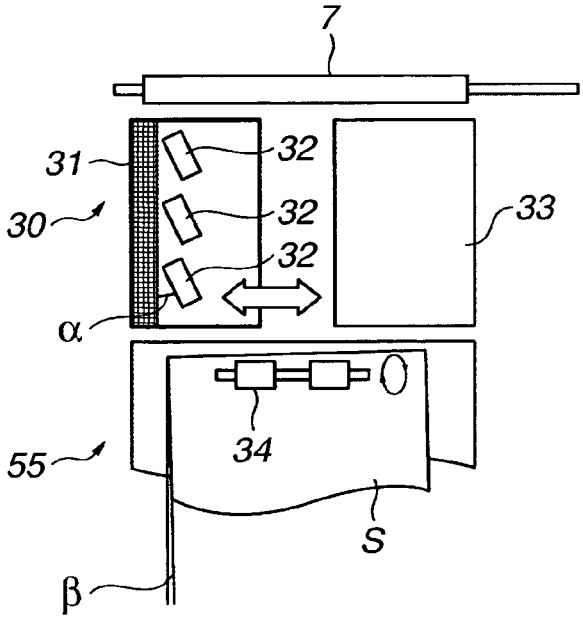
FIGS. 3A to 3D are explanatory top views illustrating a registration unit in the first embodiment of the present invention.
Figure 3B:
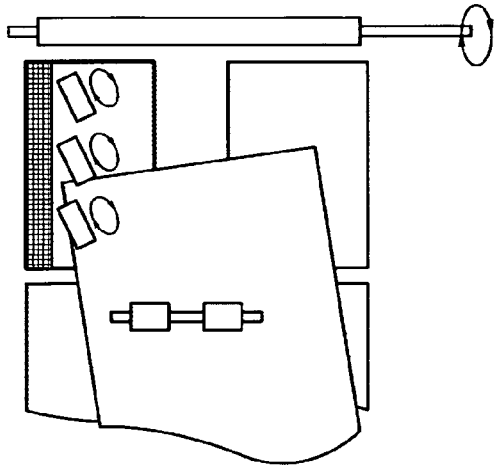

The fixed guide cannot be moved regardless of the size of the transfer material S and functions as a guide for conveying the transfer material S. When the transfer material S enters the registration unit 55 in a state in which the transfer material S has an obliquely passing angle $\beta$ as shown in FIG. 3A, the transfer material S fed by the conveyance roller 34 to the obliquely feeding roller 32 is obliquely conveyed to the abutting reference member 31 as shown in FIG. 3B. When the conveyance of the transfer material S is started by the obliquely feeding roller 32, the nipping of the conveyance roller 34 is canceled.

Figure 3C:
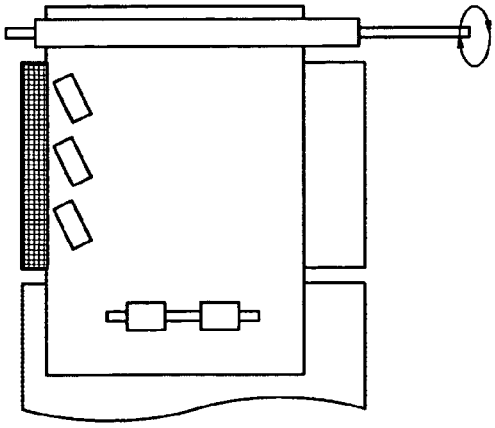
Figure 3D:
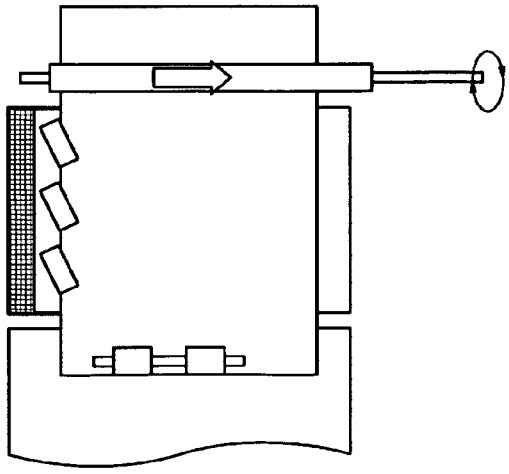

Thereafter, as illustrated in FIG. 3C, the transfer material S is conveyed to the downstream registration roller 7 while a side edge of the transfer material S is pushed against the abutting reference member 31. When the conveyance of the transfer material S is started by the registration roller 7, the obliquely feeding rollers 32 cancel the nipping thereof. Then, as shown in FIG. 3D, the registration roller 7 moves in the direction of width of the transfer material while the transfer material S is sandwiched between the roller 7 and each of the guides. Thus, the transfer material S is adjusted to the central position of the image formed on the intermediate transfer belt.

Subsequently, the registration roller 7 having transferred the transfer material S to the secondary transfer roller cancels the nipping of the transfer material S. Also, the registration roller moves in the direction of width of the transfer material again and is then put back into a job queuing state. Then, as shown in FIG. 3D, the registration roller 7 performs a reciprocating operation in the direction of width of the transfer material. This is because the abutting reference member 31 is set in view of variation in the position in the direction of width of the transfer material of the conveyed transfer material S at an offset position to prevent the transfer material S from colliding with the abutting reference member 31.

The image forming apparatus has the above-described obliquely feeding registration unit 55. Thus, the transfer material S reversed by the reversal conveyance apparatus 501 according to the switchback method (hereunder referred to as a switchback reversal) is adapted so that the same reference (end surface) of the transfer material S can abut against the abutting reference member 31, in both of the case of forming an image on one-side of the transfer material S and the case of forming images on two sides thereof. Consequently, high accuracy of the positions of images formed on the front and rear surfaces in the direction of width of the transfer material can be realized. Conversely, the accuracy of the positions of images formed on the front and rear surfaces in the direction of conveying the transfer material is unfavorable, because the leading end and the trailing end of the transfer material S are interchanged by the reversal conveyance unit 501 as a result of performing the switchback reversal, so that the reference in the direction of conveying the transfer material S is changed. Incidentally, the transfer material's first surface, on which an image is first formed, is referred to as the front surface thereof. Also, a second surface opposite to the first surface of the transfer material is referred to as a rear surface thereof. The accuracy of the position of images formed on the front and rear surfaces means the degree of accuracy in forming the image, which is to be formed on the first surface, and the image, which is to be formed on the second surface, at the same position on the transfer material.

Thus, the image forming apparatus 1 shown in FIG. 1 has a first detection position 3 and a second detection position 4, at which sensors adapted to detect the position of the transfer material S are provided, in a zone between the conveyance roller 5 and the conveyance roller 6 provided on a two-sided conveyance path 502. That is, the image forming apparatus 1 has units capable of detecting the actual length of the transfer material S, which is to be conveyed when two-sided paper refeeding is performed, with good accuracy. Theoretically, when information on the actual length of the transfer material S is provided, high accuracy of the position of the images formed on the front and rear surfaces can be achieved. Therefore, the accuracy of detecting the actual length should be enhanced.

Figure 2:
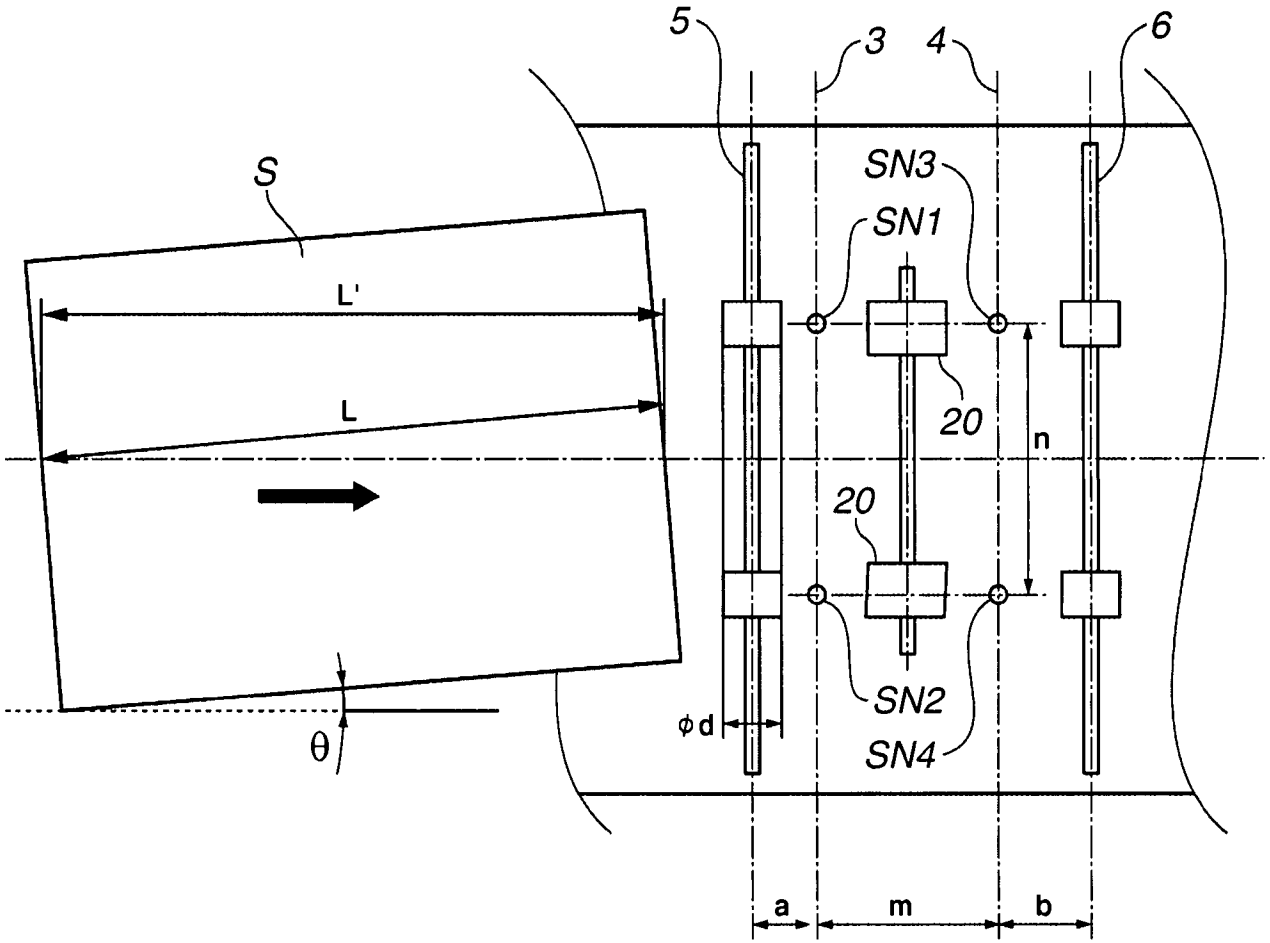
FIG. 2 is an explanatory top view illustrating the arrangement configuration of sensors in the first embodiment of the present invention.

However, when enhancing the accuracy of detecting the actual length, the influence of a minute oblique passing (that is, the transfer material S is conveyed in a state in which the transfer material S has an inclined posture), a skew (that is, the posture of the transfer material S is changed to an inclined one due to the difference in circumferential speed between left and right conveyance rollers) and variation in the conveying speed is not negligible. Therefore, in the first embodiment, the sensors are disposed and configured, as illustrated in FIG. 2, to consider and cancel the influence of such factors. Consequently, errors in detection of the length in the direction of conveying the transfer material due to the posture of the transfer material and to change in the posture thereof are corrected to thereby realize high accuracy detection of the actual length of the transfer material.

FIG. 2 is a top view illustrating a part of the two-sided conveyance path. The transfer material S is conveyed on the two-sided conveyance path in the direction of an arrow shown in this figure. The first detection position 3 and the second detection position 4 are provided between the adjacent conveyance rollers 5 and 6. Each of the first detection position 3 and the second detection position 4 has two corresponding sensors SN1 and SN2 (or SN3 and SN4) arranged at an interval N at substantially symmetrical positions with respect to a conveyance central reference (that is, a reference in a case where a conveyance reference position at the conveyance of the transfer material is set at the center).

The first detection position 3 is provided at a distance a downstream from the conveyance roller 5. The second detection position 4 is provided at a distance b upstream from the conveyance roller 6. The distance between the first detection position 3 and the second detection position 4 is set to be m. The four sensors SN1 to SN4 are disposed in this manner. According to passing signals obtained from these sensors, the apparatus performs (1) cancellation of an error in detection caused by variation in a speed at which the transfer material is conveyed, (2) cancellation of an error in detection caused by a skew, and (3) cancellation of an error in detection caused by oblique passing. Consequently, the actual length of the transfer material can be detected with high accuracy.

Practical cancellation methods are described below.

(1) Cancellation of an Error in Detection Caused by Variation in a Speed at Which the Transfer Material is Conveyed Generally, the distance m between the first detection position 3 and the second detection position 4 is already known. In a case where there are no acceleration/deceleration control operations, theoretically, the conveyance speed of the transfer material S is calculated base on the passing time period to pass through the distance m of the transfer material S. Actually, there is variation in the conveyance speed due to various factors, such as the tolerance of the diameter of the conveyance roller and a difference in temporal abrasion and the frictional resistance jointed to the transfer material S from the guides positioned upstream side and downstream side of the conveyance roller 5 and 6. Therefore, a result of calculation of the length of the transfer material S using an ideal speed instead of an actual speed includes a large amount of errors. Also, in a case where the calculation of the length of the transfer material S is performed by using only the actually measured speed obtained from the time period to pass through the distance m of the transfer material S, a result thereof includes many errors. In contrast, as the present embodiment, the error in detection caused by variation in a speed of the transfer material is canceled by using the average conveyance speed.

The following conveyance speed $V_{R1}$ of the conveyance roller 5 (that is, the conveyance speed at the rear side in this case) is obtained by using only the time period, in which mainly the conveyance roller 5 acts, and also using signals from the sensors SN1 and SN3 when the leading end of the transfer material S reaches these sensors.

$$V_{R1} = \frac{m}{t_3 - t_1}$$

where $t_1$ and $t_3$ represent moments at which ON-signals are issued from the sensors SN1 and SN3, respectively.

Similarly, the following conveyance speed of the conveyance roller 6 (that is, the conveyance speed $V_{R2}$ at the rear side in this case) is obtained by using only the time period, in which mainly the conveyance roller 6 acts, and also using signals from the sensors SN1 and SN3 when the trailing end of the transfer material S reaches these sensors.

$$V_{R2} = \frac{m}{t'_3 - t'_1}$$

where $t'_1$ and $t'_3$ represent moments at which OFF-signals are issued from the sensors SN1 and SN3, respectively.

Also, the average conveyance speed $V_{RAvg}$ (that is, the average conveyance speed at the rear side in this case) is obtained by the following equation.

$$V_{RAve} = \frac{V_{R1} + V_{R2}}{2}$$

Consequently, the accuracy of the estimation of the actual length of the transfer material S is considerably enhanced.

(2) Cancellation of an Error in Detection Caused by a Skew.

A minute difference between the conveyance speed at the front side and the rear side of the same conveyance rollers is caused due to the imbalance of the pressing force therebetween, in addition to the difference between the different conveyance rollers. Therefore, in a case where the actual length of the transfer material S is calculated from the sensor signal outputted from only one of the sensors respectively corresponding to the front side and the rear side of the same conveyance roller, the actual length may be excessively large or small due to the influence of the skew caused by the difference in the conveyance speed. In contrast, in the case of the configuration in which the sensors are provided at the front side (SN2 and SN4) and the rear side (SN1 and SN3) at substantially symmetrical positions with respect to the conveyance central reference, as shown in FIG. 2, the influence of the skew can be averaged by obtaining the condition at the central reference position from the conditions at the front side and the rear side.

Similar to the speed components $V_{R1}$, $V_{R2}$, and $V_{RAvg}$ described in (1), the front side conveyance speed components $V_{F1}$, $V_{F2}$, and $V_{FAvg}$ can also be calculated. The conveyance speed components $V_{CAvg}$ at the conveyance central reference position can be obtained by averaging the front side conveyance speed components and the rear side conveyance speed components as follows.

That is, $$V_{CAvg} = \frac{V_{FAvg} + V_{RAvg}}{2} = \frac{V_{F1} + V_{F2} + V_{R1} + V_{R2}}{4}$$

In order to obtain the actual length of the transfer material S with high accuracy, it is necessary to know the passing time period indicating that the leading end and the trailing end of the transfer material S pass through the first detection position 3 or the second detection position 4. However, there is variation in the passing time period to pass through the distance m at the front side and the rear side due to the frictional resistance jointed to the transfer material S from the guides positioned upstream side and downstream side of the conveyance roller 5 and 6.

Therefore, a passing time T at the conveyance central reference position is estimated as follows by averaging the difference $(t'_1-t_1)$, $(t'_2-t_2)$, $(t'_3-t_3)$ or $(t'_4-t_4)$ between the moments at which the detection signals are outputted from each of the sensors SN1, SN2, SN3 and SN4.

$$T = \frac{(t'_1 - t_1) + (t'_2 - t_2) + (t'_3 - t'_3) + (t'_4 - t'_4)}{4}$$

where $t_1$, $t_2$, $t_3$, $t_4$ denotes a moment at which an ON-signal is outputted from the sensor SN1, SN2, SN3, SN4, and $t'_1$, $t'_2$, $t'_3$, $t'_4$ designates a moment at which an OFF-signal is outputted from the sensor SN1, SN2, SN3, SN4.

Thus, the detected length L' at the conveyance central reference position is obtained as follows.

$$L'=V_{CAvg}T$$

Thus, the detected length L' is obtained with higher accuracy.

(3) Cancellation of an Error in Detection Caused by Oblique Passing

In the foregoing description, the detected length L' of the transfer material S at the conveyance central reference position has been described. However, the transfer material S is actually conveyed in a state having an obliquely passing angle θ, as illustrated in FIG. 2. Therefore, strictly speaking, the detected length L' obtained in (2) is a length detected in an oblique direction with respect to the length in the auxiliary direction of the transfer material S and includes an error corresponding to an obliquely passing component. In contrast, in the case of the configuration in which the sensors are arranged at the front side and the rear side at substantially symmetrical positions with respect to the conveyance central reference position, as shown in FIG. 2, the obliquely passing angle θ can be calculated from the difference between detection moments at both of the sensors.

For example, in a case where detection signals at the first detection position 3 are used, the following equation is obtained from a ratio of the difference between a moment $t_1$, at which the leading end of the transfer material S passes through the sensor SN1, and a moment $(t_1+t_2)/2$ at which the leading end of the transfer material S passes through the conveyance central reference position, to a distance (n/2) in the direction of width of the transfer material.

$$\tan\theta = \frac{(t_1 - t_2)V_{C1}}{n}$$

Meanwhile, as illustrated in FIG. 2, the relation between the actual length L of the transfer material S and the detected length L' described in (2) is given by the following equation.

$$L=L'\cos\theta$$

Thus, the actual length L of the transfer material S can be obtained with high precision by substituting the already obtained value of tan θ or θ for the left side of the aforementioned equation to thereby correct the error corresponding to the obliquely passing component.

In the foregoing description, only the leading-end obliquely passing angle θ has been described. However, in the case of the configuration shown in FIG. 2, the trailing-end obliquely passing angle at the first detection position 3 and the leading-end obliquely passing angle and the trailing-end obliquely passing angle at the second detection position 4 are obtained. Thus, correction processing using an average of each of the obliquely passing angles or the weighted average thereof can be performed, as need arises. Alternatively, it is desirable to perform a method of employing a correction table preliminarily obtained from the difference between the moments at which the ends of the transfer material S pass through the sensors provided at the front side and the rear side.

The calculations described in (1), (2), and (3) are performed in the computation unit 9 of the image forming apparatus 1. Thus, the actual length L of the transfer material S is obtained with high accuracy by canceling out various kinds of errors.

Figure 4:
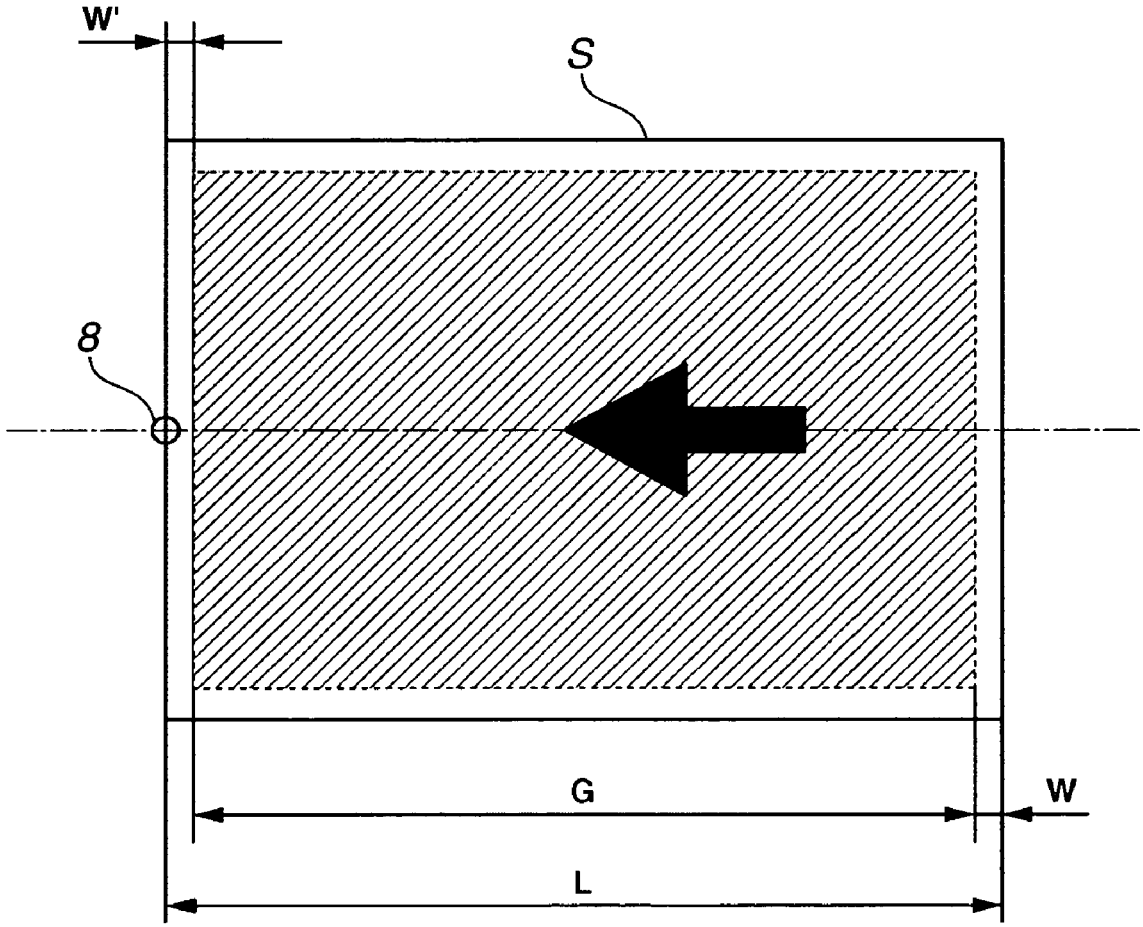
FIG. 4 is an explanatory view illustrating image position adjustment in the first embodiment of the present invention.

As illustrated in FIG. 4, in a case where the leading end of the transfer material S is detected by the sensor 8 when the transfer of the image onto the rear surface thereof is performed, and where the actual length L of the transfer material S is known in advance, the position of the trailing end (that is, the reference position for the transfer of the image onto the front surface) can be determined. When the position of the trailing end is determined, the trailing-end margin w' of the image transferred onto the front surface, that is, the leading-end margin (or the position of the image) controlled at the transfer of the image onto the rear surface is determined, because the leading-end margin w of the image transferred onto the front surface, and the length G of the image transferred from the intermediate transfer belt 506 are already known. Thus, because the actual length L of the transfer material S, of which the two-sided paper refeeding is performed, can be detected in the process of conveying the transfer material S to the registration unit 55, the timing, at which the conveyance speed of the registration roller 7 is changed, can be determined and controlled according to information on the actual length L to coincide with the timing, at which the toner image on the intermediate transfer belt is transferred. Consequently, high accuracy of positions of the images formed on the front surface and the rear surface not only in the direction of width of the transfer material but in the direction of conveying the transfer material can be realized. Incidentally, the control unit C controls the timing at which the conveyance speed of the registration roller 7 is changed.

Also, as shown in FIG. 2, detection accuracy can be enhanced by setting the distance m between the first detection position 3 and the second detection position 4 as follows:

$$m=N\pi d \text{ (N is an integer)}$$

where d is the diameter of each of the conveyance rollers 5 and 6. That is, the phases of variation of the speed due to the decentering and the runout of each of the conveyance rollers 5 and 6 can be made to coincide with each other at the first detection position 3 and the second detection position 4. Consequently, the present embodiment can obtain an advantage of preventing a range error, which occurs within a speed variation period, from being included in the actual length L of the transfer material S.

That is, even in a case where the decentering and the runout of each of the conveyance rollers 5 and 6 occur, the variations in the speed caused when the leading end and the trailing end of the transfer material reach the first detection position and the second detection position can be synchronized with each other. Consequently, errors due to the variation in the speed, which is caused by the decentering and the runout, can be canceled to thereby enhance the accuracy of detection of the length of the transfer material.

Also, as shown in FIG. 2, a pressing roller 20 is provided between the first detection position 3 and the second detection position 4. Consequently, the transfer material S can be prevented from irregularly moving in a gap of the conveyance guide. The sensors SN1 to SN4 can stably perform the detection. In the configuration shown in FIG. 2, the distances a and b are small. The suppressing effects can sufficiently be obtained by the nipping of the transfer material S by the conveyance rollers 5 and 6. Thus, the pressing roller 20 is provided only between the first detection position 3 and the second detection position 4. However, in a case where the distances a and b are relatively large, it is more effective to provide the pressing rollers just at the front side and just at the rear side of each of the sensors SN1 to SN4. Although the pressing roller 20 is provided in the apparatus shown in FIG. 2, as long as such a suppressing means is a pressing member, such as a guide adapted to abut against the transfer material S to thereby prevent the transfer material S from irregularly moving, the shape of the suppressing member is not limited to a specific one. The provision of such a pressing member is advantageous in reducing influence on the accuracy of detection by the sensors SN1 to SN4 even when curling and corrugation occur in the transfer material S.

The aforementioned processes do not include the expansion/contraction correction of the transfer material S, which is to be performed when the transfer material S passes through the fixing unit 58. The accuracy of the position of the images transferred onto the front surface and the rear surface can be considerably enhanced by taking the rate of change in the size of the transfer material, which is caused by expansion and contraction, into consideration. For example, in a case where the apparatus is provided with a table containing the values of a rate of change in the size of the transfer material according to the kinds of the transfer material, environment data, and kinds of images, an amount of correction of the rate of change is automatically referred to and is determined according to information that is inputted by a user from an operation unit and that is determined by the user.

The amount of correction of the rate of change obtained in this manner can be applied not only to the size of the image transferred onto the rear surface but to the values of the leading-end margin w of the image transferred onto the front surface and the value of the length G thereof. Consequently, an image of an appropriate size can be transferred onto an appropriate place on the rear surface. Therefore, the present embodiment can deal with a size change due to the expansion/contraction of the transfer material S. Consequently, the present invention can provide an image forming apparatus that excels in the accuracy of the positions of the images transferred onto the front surface and the rear surface of the transfer material.

Second Embodiment

Figure 5:
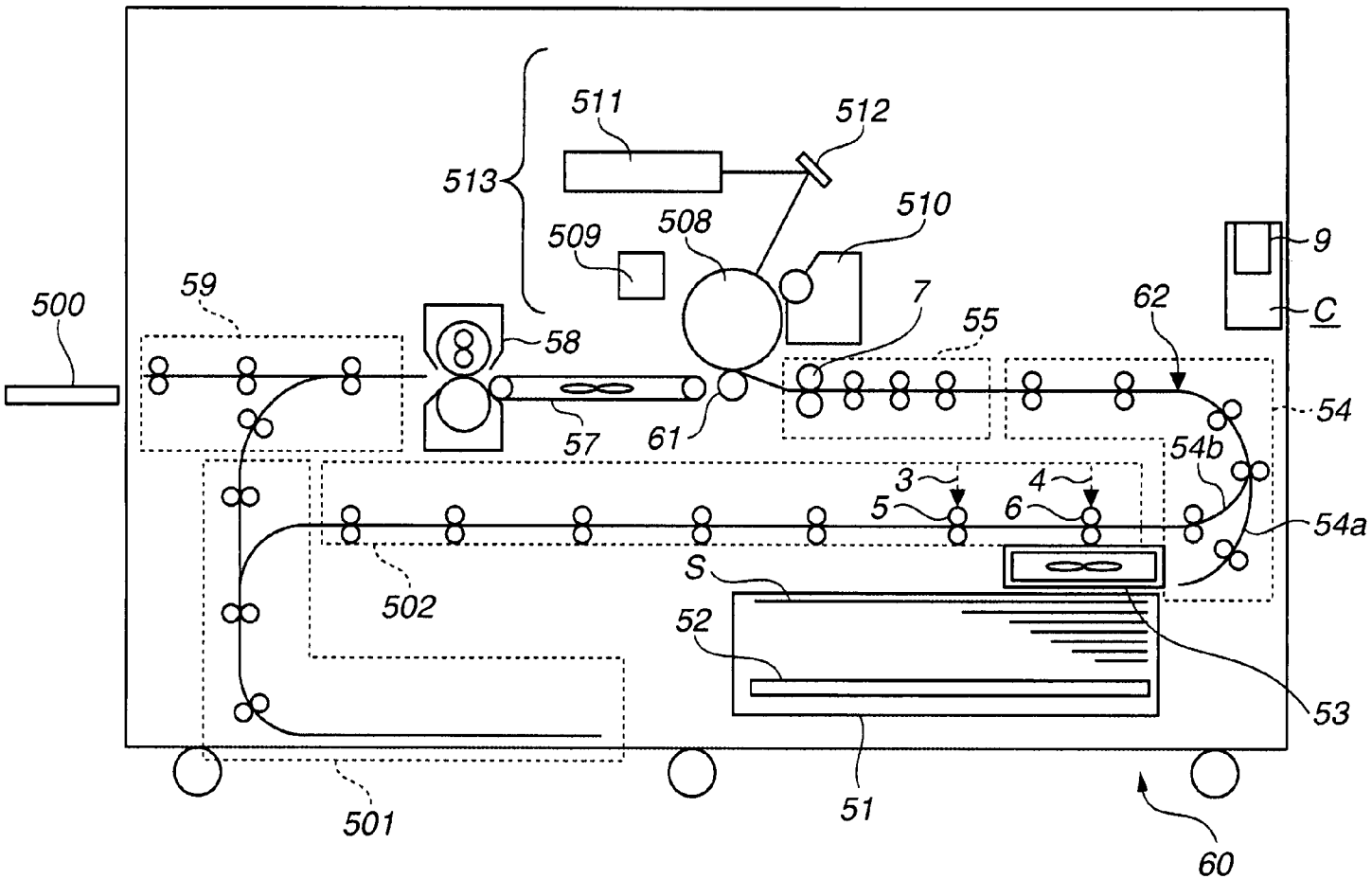
FIG. 5 is a cross-sectional view illustrating an image forming apparatus according to a second embodiment of the present invention.

FIG. 5 is a cross-sectional view illustrating an image forming apparatus according to a second embodiment of the present invention. FIG. 5 is a cross-section view illustrating a monochrome-image forming apparatus. The basic configuration and an operation of this image forming apparatus are similar to those of the color image forming apparatus already described by referring to FIGS. 1 to 4, though the apparatus shown in FIG. 5 differs slightly in image forming process from the apparatus shown in FIG. 1. In the following description, like reference numerals designate components common to these image forming apparatuses.

An image forming apparatus 60 is configured so that an electrostatic latent image formed on a photoreceptor 508 by an exposure unit 511 and a diffraction unit 512 is developed by a developing unit 510, and that subsequently, the developed image is transferred onto the transfer material S by a transfer unit 61. As already being described with reference to FIG. 1, the transfer material S is conveyed from a paper feeding unit 51 to a registration unit 55 through a conveyance path 54*a* of a conveyance unit 54. An obliquely passing correction is performed on the transfer material S in the registration unit 55. Subsequently, in the transfer unit 61, timing, with which an image is formed on the transfer material S, coincides with timing with which a toner image on the photoreceptor 508 is transferred. Incidentally, although the position adjustment of the image to the transfer material S is performed in the first embodiment by controlling the conveyance speed of the registration roller 7, the image forming apparatus 60 shown in FIG. 5 does not perform such a position adjustment, because the distance from the exposure unit to the transfer unit is short, as compared with the image forming apparatus 1 shown in FIG. 1. However, the position of the image in the direction of conveying the transfer material can be controlled by utilizing a signal outputted from a sensor 62 on the conveyance path as image forming timing. After the toner image is transferred onto the transfer material S in the transfer unit 61, the transfer material S is sent to a reversal conveyance unit 501 through a fixing unit 58 in a case where two-sided printing is performed. Then, in the reversal conveyance unit 501, the leading end and the trailing end of the transfer material S are interchanged by performing a switchback reversal operation. Subsequently, the transfer material S is conveyed to a two-sided paper conveyance unit 502.

Figure 7:
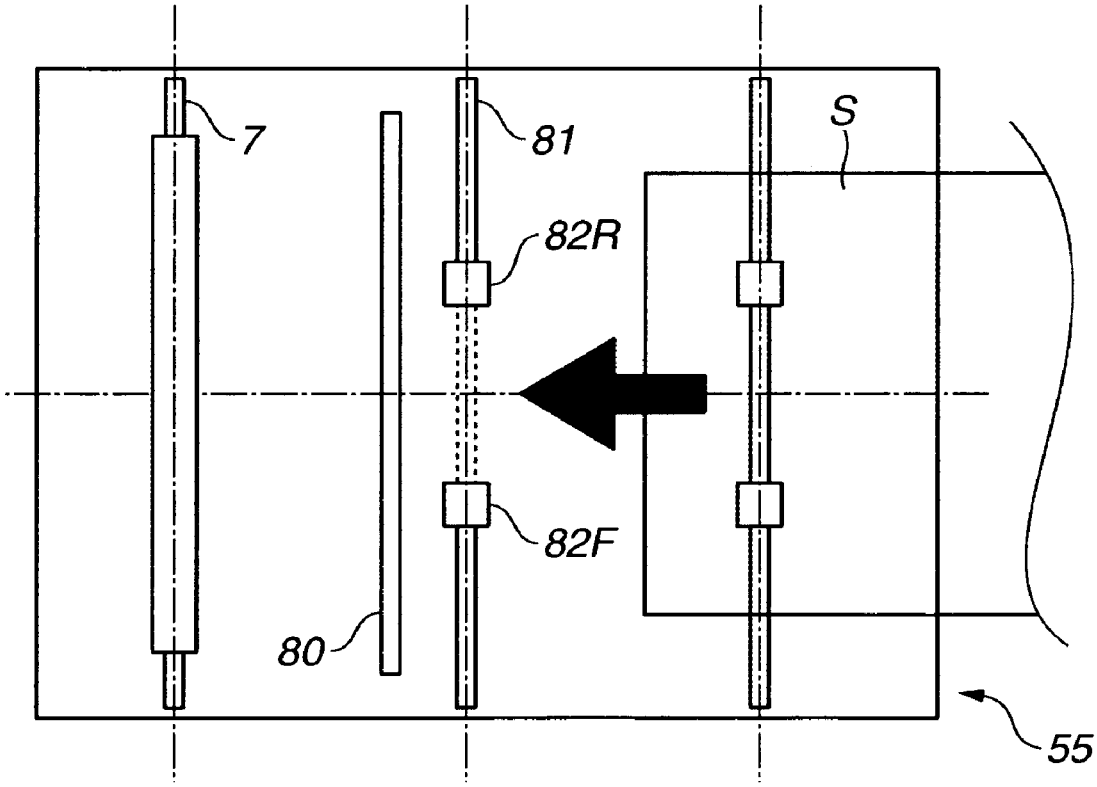
FIG. 7 is an explanatory top view illustrating a registration unit in the second embodiment of the present invention.

FIG. 7 is an explanatory top view illustrating a registration unit 55 in the image forming apparatus 60. The registration unit 55 shown in FIG. 7 causes the transfer material S to abut against a nipping unit of the registration roller 7, which is stopped by a conveyance roller 81, thereby forming a loop and preventing the transfer material S from obliquely passing. The registration unit 55 is configured to have a line sensor 80 extending in the direction of width of the transfer material, so that not only the timing, with which the transfer material S passes therethrough, but a displacement in the direction of width of the transfer material can be detected. Thus, the position of the image can be adjusted with high accuracy both in the direction of width of the transfer material and the direction of conveying the transfer material by controlling the timing, with which an image is formed in the scanning direction, according to a result of detection by the line sensor 80.

Registration unit 55 may be of what is called the active type wherein conveyance roller units 82F and 82R provided on the conveyance roller 81 are controlled by different drive motors (not shown) according to difference between the timing with which the transfer material S passes at the front side and the rear side, at which the transfer material S passes therethrough, independent of each other to thereby correct the oblique passing of the transfer material S. In this case, there is no need for making the transfer material S to abut against the registration roller 7 once and then stop. Thus, productivity can be enhanced. The registration unit of the obliquely feeding roller type described in the description of the first embodiment causes no problems in this respect. In this case, the registration unit can deal with a larger amount of an oblique passing operation.

The adjustment to the position of the image and the correction of the oblique passage can be realized by the aforementioned image forming timing and the aforementioned registration unit. However, strictly speaking, in a case where the interchange of the leading end and the trailing end (the reference) of the transfer material S by performing the switch-back reversal is not taken into consideration, this image forming apparatus is disadvantageous in accuracy. To make up for this, correction should be performed on written image data in the direction of conveying the transfer material, which is obtained according to the sensor 62 used to determine the image formation timing. Thus, the image forming apparatus 60 shown in FIG. 5 has a first detection position 3 and a second detection position 4, which include sensors adapted to detect the position of the transfer material S, in a zone between optional conveyance rollers 5 and 6 constituting a two-sided conveyance path 502. That is, the image forming apparatus 60 has units capable of detecting the actual length L of the transfer material S, which is to be conveyed when two-sided paper refeeding is performed, with good accuracy.

Figure 6:
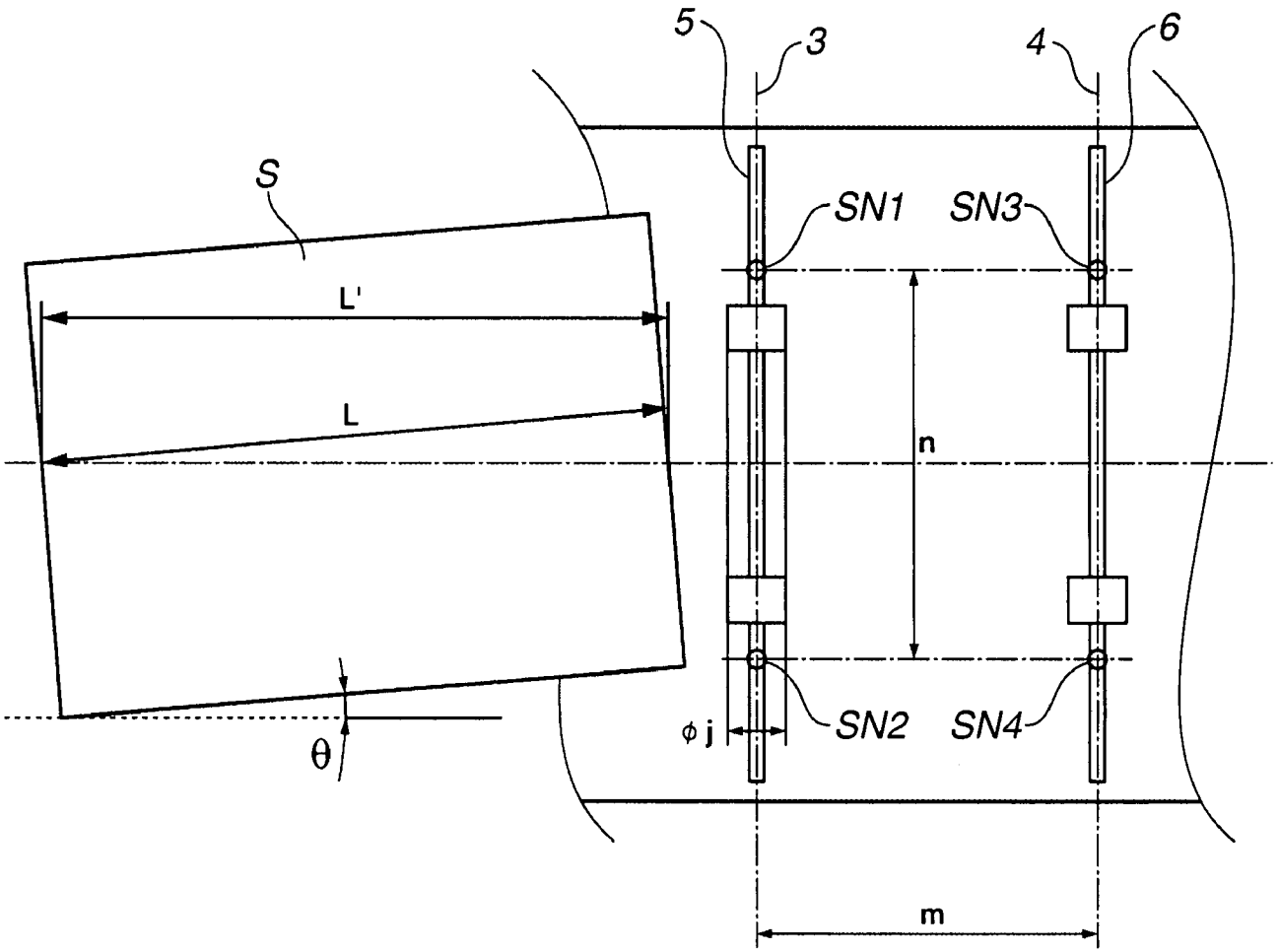
FIG. 6 is an explanatory top view illustrating the arrangement configuration of sensors in the second embodiment of the present invention.

A method of detecting the actual length L of the transfer material with high accuracy is now described by referring to FIG. 6. The configuration illustrated in FIG. 6 is basically the same as that shown in FIG. 2. Therefore, only the differences therebetween are described below. Like reference numerals designate like components in the following description. FIG. 6 is a top view illustrating a part of the two-sided conveyance path. The refeeding of the transfer material S in the direction of an arrow shown in this figure is performed through the two-sided conveyance path. The first detection position 3 and the second detection position 4 are disposed at the substantially same position as the substantially nipping position of each of the conveyance rollers 5 and 6 sequentially disposed in the direction of conveying the transfer material. Each of the first detection position 3 and the second detection position 4 has two corresponding sensors SN1 and SN2 (or SN3 and SN4) arranged at an interval N at substantially symmetrical positions with respect to the conveyance central reference. With such a configuration, the second embodiment can perform (1) the cancellation of an error in detection caused by variation in a speed at which the transfer material is conveyed, (2) the cancellation of an error in detection caused by a skew, and (3) the cancellation of an error in detection caused by oblique passing. Consequently, high accuracy of the position of images formed on the front surface and the rear surface in the direction of conveying the transfer material can be achieved. Practical cancellation methods are described below.

(1) Cancellation of an Error in Detection Caused by Variation in a Speed at Which the Transfer Material is Conveyed Generally, as illustrated in FIG. 2, the distance (a+m+b) between conveyance rollers 5 and 6 is set to be less than the minimum size specified in the specification of the image forming apparatus 60. There are necessarily the following three time periods in the process of conveying the transfer material S, that is, a time period in which mainly the conveyance roller 5 conveys the transfer material S, another time period in which mainly the conveyance roller 6 conveys the transfer material S, and another time period in which both of the conveyance rollers 5 and 6 sandwich and convey the transfer material S.

In a case where there are no acceleration/deceleration control operations, theoretically, the conveyance speeds respectively corresponding to the three time periods are equal to one another. In reality, however, there is variation in the conveyance speed due to various factors, such as the tolerance of the diameter of the conveyance roller and a difference in temporal abrasion. Therefore, a result of calculation of the length of the transfer material S using an ideal speed instead of an actual speed includes a large amount of errors. Also, in a case where the calculation of the length of the transfer material S is performed by using only the actually measured speed obtained from one of the conveyance rollers, a result thereof includes many errors. In contrast, in a case where the two detection positions are provided in the direction of conveying the transfer material shown in FIG. 2, the aforementioned three time period components can be extracted.

The following conveyance speed of the conveyance roller 5 (that is, the conveyance speed at the rear side in this case) is obtained by using only the time period, in which mainly the conveyance roller 5 acts, and also using signals from the sensors SN1 and SN3 when the leading end of the transfer material S reaches these sensors.

$$V_{R1} = \frac{m}{t_3 - t_1}$$

where $t_1$, and $t_3$ represent moments at which ON-signals are issued from the sensors SN1 and SN3, respectively.

Similarly, the following conveyance speed of the conveyance roller 6 (that is, the conveyance speed at the rear side in this case) is obtained by using only the time period, in which mainly the conveyance roller 6 acts, and also using signals from the sensors SN1 and SN3 when the trailing end of the transfer material S reaches these sensors.

$$V_{R2} = \frac{m}{t'_3 - t'_1}$$

where $t'_1$ and $t'_3$ represent moments at which OFF-signals are issued from the sensors SN1 and SN3, respectively.

Also, the conveyance speed $V_{R1+2}$ (that is, the conveyance speed at the rear side in this case) is obtained by the following equation expressed in the case of the time period in which both of the conveyance rollers 5 and 6 sandwich and convey the transfer material S and using a signal, which is outputted from the sensor SN3 when the leading end of the transfer material S reaches the sensor SN3, and a signal outputted from the sensor SN1 when the trailing end of the transfer material S reaches the sensor SN1.

$$\frac{L_{ideal} - m}{t'_1 - t_3} = \frac{L_{ideal} - (a+b)}{L_{ideal}} V_{R1+2} + \frac{b}{L_{ideal}} V_{R1} + \frac{a}{L_{ideal}} V_{R2}$$

That is, the conveyance speed in the time period from a moment, at which the leading end of the transfer material S reaches the sensor SN3, to a moment at which the trailing end thereof reaches the sensor SN1, is decomposed into the components $V_{R1}$, $V_{R2}$, and $V_{R1+2}$. Then, the conveyance speed is determined by the weighted average of these components, using the ratios determined by the distances among the conveyance rollers 5 and 6 and the first detection position 3 and the second detection position 4. Incidentally, $L_{ideal}$ represents an ideal size of the transfer material S (420 mm in a case where the transfer material S has A3-size), which is used because the rates should be calculated in a state in which the actual length L is unknown.

In the case of a=b=0 as illustrated in FIG. 6, the following equation is obtained.

$$V_{R1+2} = \frac{L_{ideal} - m}{t'_1 - t_3}$$

$L_{ideal}$ represents an ideal size of the transfer material S (420 mm in a case where the transfer material S has A3-size), which is used because the rates should be calculated in a state in which the actual length L is unknown.

As described above, the accurate conveyance speed can be calculated by obtaining the three speed components and studying the conveyance condition of the transfer material S in detail. Consequently, the accuracy of the estimation of the actual length of the transfer material S is considerably enhanced.

(2) Cancellation of an Error in Detection Caused by a Skew

A minute difference between the conveyance speed at the front side and the rear side of the same conveyance roller is caused due to the imbalance of the pressing force therebetween, in addition to the difference between the different conveyance rollers. Therefore, in a case where the actual length of the transfer material S is calculated from the sensor signal outputted from only one of the sensors respectively corresponding to the front side and the rear side of the same conveyance roller, the actual length may be excessively large or small due to the influence of the skew caused by the difference in the conveyance speed. In contrast, in the case of the configuration in which the sensors are provided at the front side (SN2 and SN4) and the rear side (SN1 and SN3) at substantially symmetrical positions with respect to the conveyance central reference, as shown in FIG. 2, the influence of the skew can be averaged by obtaining the condition from the conditions at the front side and the rear side.

Similarly to the speed components $V_{R1}$, $V_{R2}$, and $V_{R1+2}$ described in (1), the front side conveyance speed components $V_{F1}$, $V_{F2}$, and $V_{F1+2}$ can be calculated. The conveyance speed components $V_{C1}$, $V_{C2}$, and $V_{C1+2}$ at the conveyance central reference position can be obtained by averaging the front side conveyance speed components and the rear side conveyance speed components as follows.

That is, $$V_{C1} = \frac{V_{F1} + V_{R1}}{2},\ V_{C2} = \frac{V_{F2} + V_{R2}}{2},\ V_{C1+2} = \frac{V_{F1+2} + V_{R1+2}}{2}$$

In order to obtain the actual length L of the transfer material S with high accuracy, it is sufficient to know the passing signals indicating that the leading end and the trailing end of the transfer material S pass through the first detection position 3 or the second detection position 4. Hereinafter, it is considered the case that the passing signal at the first detection position 3 is used. In this case, as illustrated in FIG. 2, in consideration of the rate among the speed components corresponding to the conveyance rollers that actually serve to convey the transfer material S, the average conveyance speed $V_c$ at the conveyance central reference position is estimated by the following equation.

$$V_C = \frac{m+b}{L_{ideal}} V_{C1} + \frac{L_{ideal} - m - a - b}{L_{ideal}} V_{C1+2} + \frac{a}{L_{ideal}} V_{C2}$$

In the case of a=b=0 as illustrated in FIG. 6, the following equation is obtained.

$$V_C = \frac{m}{L_{ideal}} V_{C1} + \frac{L_{ideal} - m}{L_{ideal}} V_{C1+2}$$

A passing time T at the conveyance central reference position is estimated as follows by averaging the difference ($t'_1 - t_1$) or ($t'_2 - t_2$) between the moments at which the detection signals are outputted from each of the sensors SN1 and SN2.

$$T = \frac{(t'_1 - t_1) + (t'_2 - t_2)}{2}$$

Thus, the detected length $L'_1$ at the conveyance central reference position is obtained as follows.

$$L'_1 = V_c T$$

According to a similar theory, the detected length $L'_2$ in a case in which the passing signal outputted from the second detection position 4 is used, is obtained as follows.

$$L' = (L'_1 + L'_2)/2$$

Thus, the detected length L' is obtained with higher accuracy.

(3) Cancellation of an Error in Detection Caused by Oblique Passing

In the foregoing description, the detected length L' of the transfer material S at the conveyance central reference position has been described. However, the transfer material S is actually conveyed at an obliquely passing angle θ, as illustrated in FIG. 2. Therefore, strictly speaking, the detected length L' obtained in (2) is a length detected in an oblique direction with respect to the length in the auxiliary direction of the transfer material S and includes an error corresponding to an obliquely passing component. In contrast, in the case of the configuration in which the sensors are arranged at the front side and the rear side at substantially symmetrical positions with respect to the conveyance central reference position, as shown in FIG. 6, the obliquely passing angle θ can be calculated from the difference between detection moments at both of the sensors.

For example, in a case where detection signals at the first detection position 3 are used, the following equation is obtained from a ratio of the difference between a moment $t_1$, at which the leading end of the transfer material S passes through the sensor SN1, and a moment $(t_1+t_2)/2$ at which the leading end of the transfer material S passes through the conveyance central reference position, to a distance (n/2) in the direction of width of the transfer material.

$$\tan\theta = \frac{(t_1 - t_2)V_{C1}}{n}$$

Meanwhile, as illustrated in FIG. 2, the relation between the actual length L of the transfer material S and the detected length L' described in (2) is given by the following equation.

$$L = L' \cos\theta$$

Thus, the actual length L of the transfer material S can be obtained by substituting the already obtained value of tan θ or θ for the left side of the aforementioned equation to thereby correct the error corresponding to the obliquely passing component.

In the foregoing description, only the leading-end obliquely passing angle θ has been described. However, in the case of the configuration shown in FIG. 6, the trailing-end obliquely passing angle at the first detection position 3 and the leading-end obliquely passing angle and the trailing-end obliquely passing angle at the second detection position 4 are obtained. Thus, correction processing using an average of each of the obliquely passing angles or the weighted average thereof can be performed, as need arises. Alternatively, it is desirable to perform a method of employing a correction table preliminarily obtained from the difference between the moments at which the ends of the transfer material S pass through the sensors provided at the front side and the rear side.

The calculations described in (1), (2), and (3) are performed in the computation unit 9 of the image forming apparatus 60. Thus, the actual length L of the transfer material S is obtained with high accuracy by canceling various kinds of errors. As illustrated in FIG. 4, in a case where the leading end of the transfer material S is detected by the sensor 8 when the transfer of the image onto the rear surface thereof is performed, and where the actual length L of the transfer material S is known in advance, the position of the trailing end (that is, the reference position for the transfer of the image onto the front surface) can be determined.

When the position of the trailing end is determined, the trailing-end margin w' of the image transferred onto the front surface, that is, the leading-end margin (or the position of the image) controlled at the transfer of the image onto the rear surface is determined, because the leading-end margin w of the image transferred onto the front surface, and the length G of the image are already known. Thus, in a case where the actual length L of the transfer material S, the two-sided paper refeeding of which is performed, can be detected before the writing of the image formed on the rear surface is performed, the timing, with which the writing of the image by the exposure unit 511 is performed, can be determined and controlled to coincide with timing corresponding to the margin w'. Consequently, high accuracy of positions of the images formed on the front surface and the rear surface not only in the direction of width of the transfer material but in the direction of conveying the transfer material can be realized.

In the apparatus shown in FIG. 6, the first detection position 3 and the second detection position 4 are set at the substantially nipping positions of the conveyance rollers 5 and 6, respectively. Thus, the transfer material S is sandwiched between rollers 5 and 6 and detection units of the sensors SN1 to SN4, respectively. Consequently, the posture of the transfer material is not affected by the floppiness and the curling of the transfer material S in the gap of the conveyance guide and is stabilized. Also, it becomes unnecessary to additionally provide the pressing roller 20 described in the description of the first embodiment. Consequently, the second embodiment can obtain merits in simplifying the configuration and in reducing the costs thereof.

Also, as shown in FIG. 6, detection accuracy can be enhanced by setting the distance m between the first detection position 3 and the second detection position 4 as follows:

$$m=N\pi d \text{ (N is an integer)}$$

where d is the diameter of each of the conveyance rollers 5 and 6. That is, the phases of variation of the speed due to the decentering and the runout of each of the conveyance rollers 5 and 6 can be made to coincide with each other at the first detection position 3 and the second detection position 4. Consequently, the present embodiment can obtain an advantage of preventing a range error, which occurs within a speed variation period, from being included in the actual length L of the transfer material S.

The aforementioned processes do not include the expansion/contraction correction of the transfer material S, which is to be performed when the transfer material S passes through the fixing unit 58. The accuracy of the position of the images transferred onto the front surface and the rear surface are considerably enhanced by taking into consideration the rate of change in the size of the transfer material, which is caused by expansion and contraction. For example, in a case where the apparatus 60 is provided with a table containing the values of a rate of change in the size of the transfer material according to the kinds of the transfer material, environment data, and kinds of images, an amount of correction of the rate of change is automatically referred to and is determined according to information that is inputted by a user from an operation unit and that is determined by the user.

The amount of correction of the rate of change obtained in this manner can be applied not only to the size of the image transferred onto the rear surface but to the values of the leading-end margin w of the image transferred onto the front surface and the value of the length G thereof. Consequently, an image of an appropriate size can be transferred onto an appropriate place on the rear surface. Therefore, the present embodiment can deal with a size change due to the expansion/contraction of the transfer material S. Consequently, the present invention can provide an image forming apparatus that excels in the accuracy of the positions of the images transferred onto the front surface and the rear surface of the transfer material.

Third Embodiment

Figure 8:
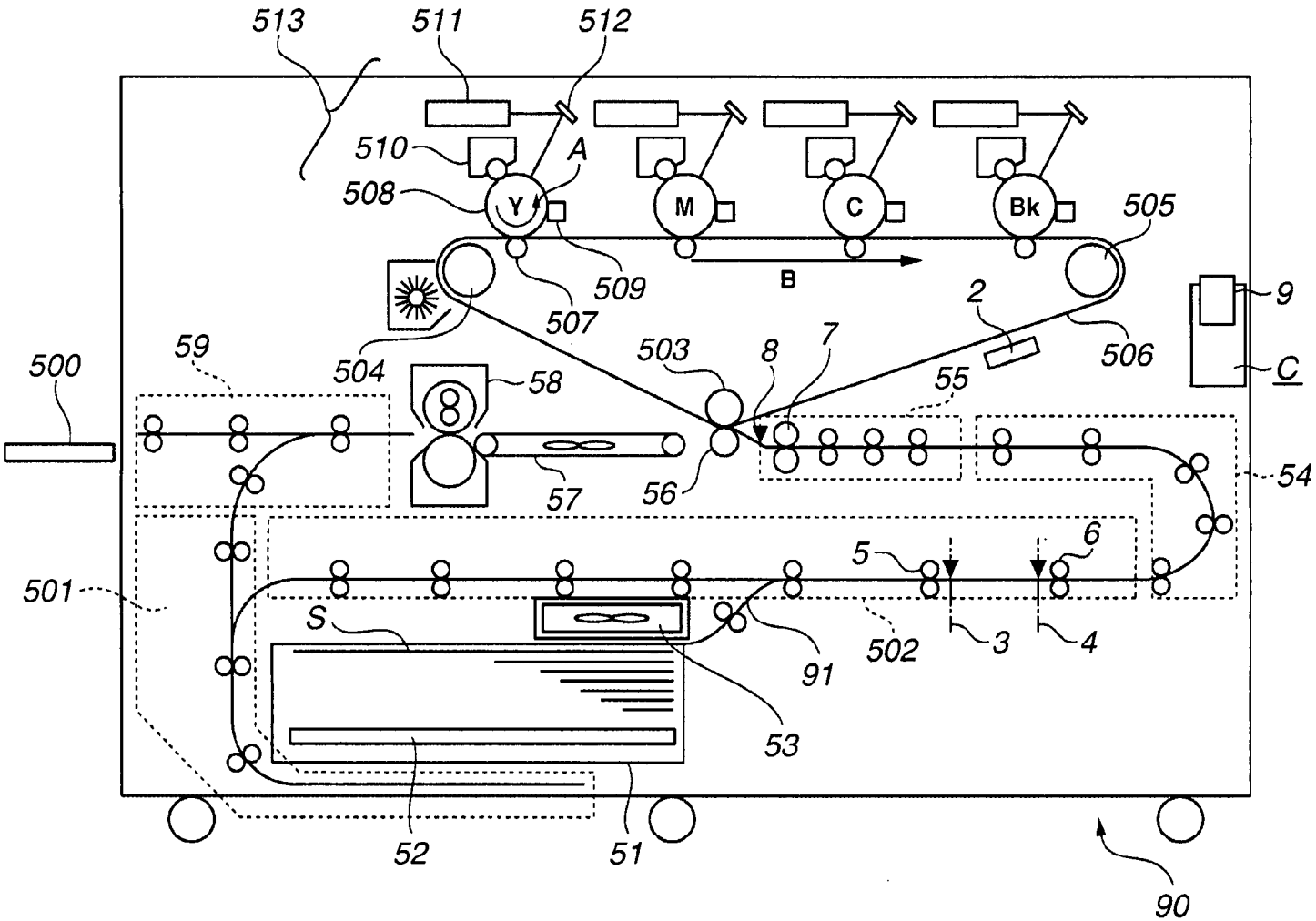
FIG. 8 is a cross-sectional view illustrating an image forming apparatus according to a third embodiment of the present invention.

FIG. 8 is a cross-sectional view illustrating an image forming apparatus according to a third embodiment of the present invention. The image forming apparatus shown in FIG. 8 is similar in basic configuration and operation to the image forming apparatuses shown in FIGS. 1 and 5. Like reference numerals designate each common part. The image forming apparatus 90 shown in FIG. 1 is of the intermediate transfer tandem type that has four image forming units 513 respectively corresponding to the colors Y, M, C, and Bk on an intermediate transfer belt 506.

The image forming apparatus 90 shown in FIG. 8 is configured so that a path, through which the transfer material S is fed from a paper feeding unit 51, is joined from a confluence path 91 with a middle part of the two-sided conveyance path 502. Then, the transfer material S is conveyed to the registration unit 55 through a conveyance unit 54. Similar to the first embodiment (see FIGS. 3A to 3D), the registration unit 55 is of the type adapted to perform correction of the oblique passing by using an obliquely feeding roller 32 and an abutting reference member 31. The image forming apparatus 90 can make the transfer material S and the leading end of the image according to a method, which is similar to that used in the first embodiment (see FIG. 1), coincide with each other. The fixing performed after the secondary transfer, the reversal conveyance (that is, the switchback reversal), and the two-sided conveyance have been described with reference to FIGS. 1 and 5. Therefore, the description thereof is omitted herein.

As described above, the image forming apparatus has the above-described obliquely feeding registration unit 55. Thus, the transfer material S reversed by the reversal conveyance apparatus 501 according to the switchback method is adapted so that the same reference (end surface) of the transfer material S can abut against the abutting reference member 31, in both the case of forming an image on one-side of the transfer material S and the case of forming images on two sides thereof. Consequently, high accuracy of the positions of images formed on the front and rear surfaces in the direction of width of the transfer material can be realized. Conversely, the accuracy of the positions of images formed on the front and rear surfaces in the direction of conveying the transfer material is unfavorable, because the leading end and the trailing end of the transfer material S are interchanged by the reversal conveyance unit 501 by performing the switchback reversal, so that the reference in the direction of conveying the transfer material S is changed. To make up for this, the image forming apparatus 90 shown in FIG. 8 has units capable of detecting the actual length of the transfer material S provided on the two-sided conveyance path 502, similarly to the first embodiment (see FIG. 2). The detailed arrangement of the sensors and the method of detecting the actual length L are similar to those of the first embodiment. Therefore, the description thereof is omitted herein.

In the image forming apparatus 90 shown in FIG. 8, a position, at which the confluence path 91 is joined with the two-sided conveyance path 502, is set upstream from the conveyance roller 5. Consequently, the actual lengths L of not only the transfer material S, which is sent to the two-sided conveyance path, but the transfer material S supplied from the paper feeding unit 51 can be detected. Consequently, the correction of the rate of change in size (the correction of magnification) of the transfer material S, which is uniformly corrected according to information inputted by an operator from an operation unit in the first embodiment and the second embodiment, can be performed automatically. This provides advantages that workload imposed on an operator is alleviated, and that variation in expansion/contraction, which cannot be cancelled by uniform correction, can be cancelled by performing expansion/contraction correction on each of the transfer materials S. Hereinafter, the expansion/contraction correction is described in detail.

First, the transfer material S, which is supplied from the paper feeding unit 51 and is sent to undergo the transfer of an image onto the front surface thereof, passes through the first detection position 3 and the second detection position 4. Thus, the original and actual length $L_1$ is detected. Information on the actual length $L_1$ is stored in a memory unit. Also, a transfer material corresponding to the information on the actual length $L_1$ is identified by a unit adapted to count the order of feeding paper from the paper feeding unit 51 and the order of conveying the transfer material S to the two-sided conveyance path 502.

Consequently, the relative comparison can be made between the actual length $L_1$ and that L2 that is detected when the transfer material S, which undergoes the transfer of the image onto the rear surface after the switchback reversal, passes through the first detection position 3 and the second detection position 4 again. Generally, the actual length L2 is changed from the original actual length L1 due to change in moisture, which is caused when the transfer material S passes through the fixing unit 58. Information on the expansion/contraction rate and the actual length $L_2$ of the transfer material S is preliminarily inputted to the image forming unit 513 and the registration unit 55. Consequently, the positions and the magnifications of the images formed on the front surface and the rear surface can be made to coincide with each other.

More specifically, when the leading end of the transfer material S, on the rear surface of which the image is transferred, is detected by the sensor 8, the trailing end of the transfer material S is determined according to information on the actual length $L_2$ as illustrated in FIG. 4. The trailing-end margin w' of the image formed on the front surface, that is, the leading-end margin (the position of the image) to be controlled at the transfer of the image onto the rear surface is determined from the modified values of the leading-end margin w and the image length G of the known image formed onto the front surface by taking change in magnification into account. Therefore, the timing with which the conveyance speed of the registration roller 7 is changed is determined.

On the other hand, the image formed onto the rear surface itself is exposed and developed so as to have a size set by taking the preliminarily inputted value of change in the magnification into consideration. When the image is secondary-transferred at the position of the margin w', a print, in which the positions of the images formed on the front and rear surfaces are appropriate, can be obtained. With the configuration of the present invention, the aforementioned image position adjustment can be applied to each of the transfer materials. Thus, an image forming apparatus with improved accuracy of the position of each of the images formed on the front and rear surfaces can be provided.

Although the third embodiment is the color image forming apparatus of the intermediate transfer tandem type, a monochrome image forming apparatus having high accuracy of the position of each of the images formed on the front and rear surfaces in consideration of correction of magnification can be obtained by similarly setting the position, at which the confluence path 91 extending from the paper feeding unit is joined with the middle of the two-sided conveyance path 502, upstream from the conveyance roller 5. In this case, it is advisable to make the apparatus have the configuration, which is required to detect the actual length of the transfer material S, as illustrated in FIG. 2 or 6, which has been described. Also, it is advisable to employ the registration unit of the type illustrated in FIG. 3 or 7, which has been described.

Although the third embodiment has a configuration in which the confluence path 91 is joined with the middle of the two-sided conveyance path, the configuration according to the present invention is not limited thereto. It is sufficient that a unit adapted to detect the actual length of the transfer material S with good accuracy is provided in the conveyance path through which both of the transfer materials S respectively undergoing the transfer of an image to the front surface of the transfer material S and the transfer of an image to the rear surface of the transfer material S are passed.

The registration unit according to the present invention is not limited to the registration units which are used to adjust the position of an image formed on a transfer material and have been described in the foregoing description of the embodiments. The registration unit may be adapted so that a transfer material is temporarily stopped by a registration roller and that the registration roller is driven to feed a transfer material by adjusting the position thereof to the position of an image formed on an image carrier.

While the present invention has been described with reference to exemplary embodiments, it is to be understood that the invention is not limited to the disclosed exemplary embodiments, but encompasses all modifications, equivalent structures and functions.

This application claims priority from Japanese Patent Application No. 2005-155534 filed May 27, 2005, which is hereby incorporated by reference herein in its entirety.

What is claimed is:

1. An image forming apparatus having an image forming unit adapted to form an image on a transfer material, comprising:

a first conveyance unit and a second conveyance unit serially arranged along a direction of conveyance of the transfer material;

a first sensor and a second sensor, arranged along a direction perpendicular to the direction of conveyance of the transfer material, at a first detection position provided between the first conveyance unit and the second conveyance unit, to detect a leading end and a trailing end of the transfer material for determining a posture, or change in posture, of the transfer material;

a third sensor and a fourth sensor, arranged along the direction perpendicular to the direction of conveyance of the transfer material, at a second detection position provided downstream from the first detection position, to detect a leading end and a trailing end of the transfer material for determining a posture, or change in posture, of the transfer material;

a computation unit adapted to calculate a length of the transfer material by correcting an error in detection of the length in the direction of conveyance of the transfer material caused by a posture of the transfer material, said computation unit calculating the length of the transfer material according to detection signals detected by the first to the fourth sensors; and a control unit adapted to adjust an image forming position on the transfer material according to length information on the length in the direction of conveyance of the transfer material, which is obtained by the computation unit, wherein the first sensor and the third sensor are disposed on opposite sides of a conveyance central reference for a transfer material, which serves as a boundary therebetween, wherein the second sensor and the fourth sensor are disposed on opposite sides of a conveyance central reference for a transfer material, which serves as a boundary therebetween, and wherein the computation unit calculates a first conveyance time of conveying a transfer material at one of the sides in a direction perpendicular to a conveyance direction of the transfer material according to detection signals corresponding to a leading end and a trailing end of the transfer material, which are detected by the first sensor and the third sensor, by employing the conveyance central reference, which serves as a boundary therebetween, wherein the computation unit calculates a second conveyance time of conveying a transfer material at the other side in the direction perpendicular to the conveyance direction of the transfer material according to detection signals corresponding to the leading end and the trailing end of the transfer material, which are detected by the second sensor and the fourth sensor, by employing the conveyance central reference, which serves as a boundary therebetween, wherein the computation unit calculates an average conveyance time of the transfer material at the conveyance central reference position by averaging the first conveyance time and the second conveyance time, and wherein the computation unit calculates a length of the transfer material according to the average conveyance time.

2. The image forming apparatus according to claim 1, wherein the computation unit extracts from a conveyance speed of conveying a transfer material, which is used to calculate a length of the transfer material, into a conveyance speed at which a transfer material is conveyed by the first conveyance unit, a conveyance speed at which a transfer material is conveyed by the second conveyance unit, and a conveyance speed at which a transfer material is conveyed by simultaneously using the first conveyance unit and the second conveyance unit, and wherein each of the conveyance speeds is calculated by weighted averaging according to ratios determined by distances in a direction of conveyance of a transfer material among the first conveyance unit, the first detection position, the second detection position, and the second conveyance unit.

3. The image forming apparatus according to claim 1, wherein the first conveyance unit and the second conveyance unit have conveyance rollers having a same diameter, and wherein a distance in the conveyance direction of a transfer material between the first detection position and the second detection position is substantially an integral multiple of a circumference of each of the conveyance rollers.

4. The image forming apparatus according to claim 1, further comprising a pressing member adapted to press, when a transfer material is conveyed, the transfer material between the first detection position and the second detection position.

5. The image forming apparatus according to claim 1, wherein the first detection position substantially coincides with a position of the first conveyance unit in a conveyance direction of a transfer material, and wherein the second detection position substantially coincides with a position of the first conveyance unit in the conveyance direction of the transfer material.

6. The image forming apparatus according to claim 1, further comprising:

a two-sided conveyance unit adapted to interchange a leading end and a trailing end of a transfer material reversing the transfer material, in which an image is formed by the image forming unit on a first surface thereof, said two-sided conveyance unit adapted to form an image on a second surface thereof by feeding the transfer material to the image forming unit again, wherein the first conveyance unit, the second conveyance unit, and the first to fourth sensors are disposed in a two-sided conveyance path of the two-sided conveyance unit, and wherein the computation unit calculates a length of a transfer material, which passes through the two-sided conveyance unit, according to detection information outputted from each of the sensors.

7. The image forming apparatus according to claim 6, further comprising:

a detection sensor provided downstream from the second detection position and adapted to detect passage of a transfer material, wherein the control unit controls image formation on the transfer material so that the image formed on the first surface and the image formed on the second surface coincide with each other according to a detection signal outputted by the detection sensor, wherein the detection signal represents detection of the transfer material, which is supplied again by the two-sided conveyance unit to form the image on the second surface, and according to information on a length in the conveyance direction of the transfer material which is calculated by the computing unit.

8. The image forming apparatus according to claim 6, further comprising:

an image carrier adapted to carry a toner image to be transferred by the image forming unit onto the transfer material, a pattern detection unit adapted to detect an image pattern formed on the image carrier, a registration roller provided upstream of the image forming unit, and a registration sensor adapted to detect passage of the transfer material, wherein the control unit controls a conveyance speed of the registration roller so that a position at which an image is formed on a first surface coincides with a position at which an image is formed on a second surface, according to information of a position of an image on the image carrier obtained by the pattern detection unit, to a passing signal, which is obtained by the registration sensor and indicates that the transfer material passes therethrough, and to information, which is obtained by the computation unit and represents a length in the conveyance direction of the transfer material.

9. The image forming apparatus according to claim 6, further comprising:

an image carrier adapted to carry a toner image to be transferred by the image forming unit onto the transfer material;

a fixing unit adapted to fix a toner image transferred onto the transfer material by the image carrier; and a setting unit adapted to set a rate of change in size of the transfer material having passed through the fixing unit, wherein the control unit is adapted to control an operation of forming images in the image forming unit according to information on a length of the transfer material conveyed by the two-sided conveyance unit and to a rate of change set by the setting unit so as to make a magnification of an image formed on the first surface and that of an image formed on the second surface coincide with each other.

10. The image forming apparatus according to claim 1, further comprising:

a paper feeding unit adapted to supply a transfer material to the image forming unit; and a two-sided conveyance unit adapted to interchange a leading end and a trailing end of a transfer material, in which an image is formed on a first surface thereof by the image forming unit, and to feed the transfer material to the image forming unit again to form an image on a second surface;

wherein a two-sided conveyance path of the two-sided conveyance unit is joined with a conveyance path between the paper feeding unit and the image forming unit at a joining part, wherein the first and second conveyance units and the first to fourth sensors are arranged on a conveyance path between the joining part and the image forming unit, and wherein the computation unit calculates a length of a transfer material in a conveyance direction sent from the paper feeding unit and calculates a length of the transfer material in a conveyance direction conveyed through the two-sided conveyance path according to detection information from each of the sensors.

11. The image forming apparatus according to claim 10, wherein the computation unit calculates a length in the conveyance direction of the transfer material sent from the paper feeding unit, and is adapted to detect a length in the conveyance direction of the transfer material, which has an image formed by the image forming unit and is outputted from the two-sided conveyance unit, and wherein the control unit is adapted to obtain change in magnification from the lengths calculated before an image is formed on the transfer material and after an image formed on the transfer material, and control an image forming operation in the image forming unit according to the change in magnification to cause a magnification of an image formed on a first surface and that of an image formed on a second surface to be equal to each other.

* * * * *